US005225736A

United States Patent [19]

Fujiwara et al.

[11] Patent Number: 5,225,736

[45] Date of Patent: Jul. 6, 1993

[54] COLOR CATHODE RAY TUBE APPARATUS

[75] Inventors: Takeshi Fujiwara, Kumagaya; Kiyoshi Tokita; Masatsugu Inoue, both of Fukaya, all of Japan

[73] Assignee: Kabushiki Kaisha Toshiba, Kawasaki, Japan

[21] Appl. No.: 696,755

[22] Filed: May 7, 1991

Related U.S. Application Data

[63] Continuation-in-part of Ser. No. 371,844, Jun. 27, 1989, abandoned.

[30] Foreign Application Priority Data

Jun. 27, 1988 [JP] Japan ..... 63-156974
May 10, 1990 [JP] Japan ..... 2-118683

[51] Int. Cl.[5] ..... H01J 29/54; H01J 29/76

[52] U.S. Cl. ..... 313/440; 313/414; 335/212

[58] Field of Search ..... 313/440, 414; 358/248, 358/249; 335/211, 212, 213, 214

[56] References Cited

FOREIGN PATENT DOCUMENTS

| | | |
|---|---|---|
| 0243541 | 11/1987 | European Pat. Off. . |
| 0301242 | 4/1989 | European Pat. Off. . |
| 1199891 | 9/1965 | Fed. Rep. of Germany . |
| 3146441 | 7/1982 | Fed. Rep. of Germany . |
| 59-3018 | 1/1984 | Japan . |
| 59-101745 | 6/1984 | Japan . |
| 59-33931 | 8/1984 | Japan . |
| 61-6966 | 3/1986 | Japan . |
| 1567669 | 5/1980 | United Kingdom . |

*Primary Examiner*—Sandra L. O'Shea
*Attorney, Agent, or Firm*—Cushman, Darby & Cushman

[57] ABSTRACT

The invention provides a novel color cathode ray tube apparatus incorporating an eight-pole permanent magnet means, and thereby deflective aberration of electron beams caused by deflected magnetic field can securely be minimized. Integral structure of a plurality of magnetic poles permits the concerned to easily form up the eight-pole permanent magnet ring.

22 Claims, 18 Drawing Sheets

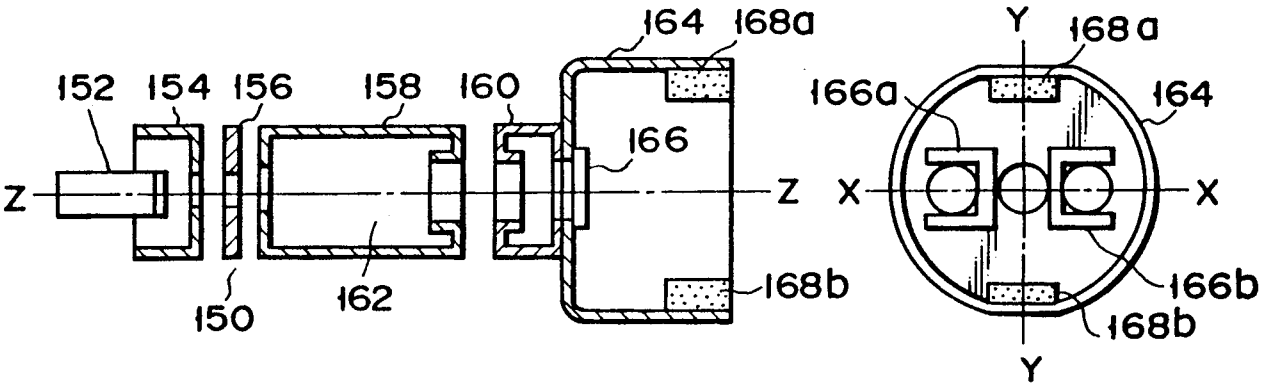
FIG. 15A
FIG. 15B
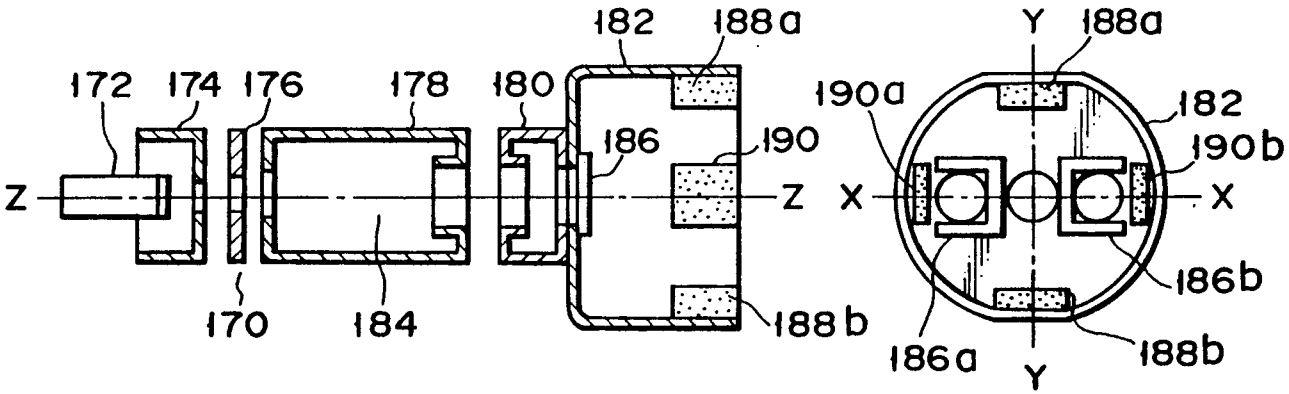
FIG. 16A
FIG. 16B

COLOR CATHODE RAY TUBE APPARATUS

CROSS REFERENCE TO THE RELATED APPLICATION

This application is a continuation-in-part of application U.S. Ser. No. 371,844 filed on Jun. 27, 1989, abandoned.

BACKGROUND OF THE INVENTION

1. Field of the Invention

This invention relates to a color cathode ray tube apparatus, and particularly to a color cathode ray tube apparatus which provides a high focusing characteristic and in which the deflection aberrations of electron-beams are reduced which are caused by the deflection magnetic field produced by a deflection device for use in the color cathode ray tube apparatus, and also relates to a deflection device for use therein.

2. Description of the Related Art

A color cathode ray tube apparatus of shadow mask type comprises a panel section having a generally rectangular face plate and a skirt extending from a lateral edge of the face plate, a funnel section connected to the panel section, and a neck section continuously formed with the funnel section. The interior of the cathode ray tube is maintained in a vacuum state by the panel section, the funnel section and the neck section. In the neck section is housed an electron gun assembly which generates three electron beams (R), (G) and (B). At the outer lateral side of the portion of the apparatus between the funnel section and the neck section is disposed a deflection device for generating magnetic fields which deflect electron beams vertically and horizontally. A phosphor screen is formed on the inner face of the face plate of the panel. In the tube, a generally rectangular shadow mask is opposed to the face plate at a predetermined spacing. The shadow mask is made of a thin metal plate and provided with a lot of slit apertures.

The deflection device for use in the color cathode ray tube apparatus of shadow mask type has a horizontal deflection coil and a vertical deflection coil which produce magnetic fields for respectively horizontally and vertically deflecting the there electron beams (R), (G), (B) emitted from the electron gun assembly. After deflected by the horizontal and vertical deflection coils, the three electron beams (R), (G) and (B) are converged towards the corresponding slit. The electron beams (R), (G) and (B) converged at the vicinity of the slit are landed on the phosphor screen which has three kinds of phosphor stripes alternately, arranged to each other. The three electron beams (R), (G) and (B) pass the slit and are incident on the phosphor screen, whereby the red light, green light and blue light are emitted from the phosphor stripes. In other words, the three beams are landed on the corresponding phosphor stripes which emit the red, green and blue light.

When the electron gun assembly is of inline type, the electron beam (G) which causes green light to be emitted is radiated from the electron gun so as to coincide with the tube axis. The electron beams (B) and (R) which cause blue light and red light to be emitted, respectively, are radiated, with the electron beam (G) disposed therebetween. The color cathode ray tube apparatus, which employs the characteristic of the in-line type electron gun to produce specific non-uniform magnetic fields by means of deflection yokes, is a self-convergence type color cathode ray tube apparatus With the color cathode ray tube of this type in which the three electron beams are radiated on the same horizontal plane, for example, a horizontal deflection magnetic field of mainly pincushion type and a vertical deflection magnetic field of mainly barrel type are applied. The impression of these magnetic fields enables the three electron beams radiated on the same horizontal plane to be converged on the phosphor screen.

However, with this inline type color cathode ray tube apparatus, the center beam (G) and the side beams (B) and (R) do not converge well each other to produce coma aberration on the peripheral portion of the screen. Japanese Patent Publications No. Sho 51-26208 and Sho 54-23208 describe an apparatus wherein an electron gun assembly is provided, for the correction of the coma aberration, with magnetic substance which changes a shape of the after-leakage magnetic field which is a part of the magnetic field generated by a deflection device. Japanese Utility Model Publication No. Sho 57-45748 discloses another apparatus in which an auxiliary coil is provided at the side of the electron gun of a deflection device and is adapted to render an electrical current to flow in synchronism with the deflection current flowing in a vertical deflection coil, thereby generating a strong pincushion type magnetic field.

With the color cathode ray tube apparatus in which the correction means for coma aberration is provided, however, the beam spots formed on a screen by the beams are distorted, because a non-uniform magnetic filed is employed as the deflection magnetic field. In other words, when a uniform magnetic field is impressed, the beam spots assume a substantially truly circular shape over the whole surface of the screen. However, referring to FIGS. 1, 2A and 2B, the beam spots 4 formed on the X-axis by the electron beams at the horizontal side end portions of the screen receive, by means of a pincushion type horizontal magnetic field, Lorentz's forces which press the electron beams above the X-axis downward and the electron beams below the X-axis upward, and the beam spots 4 are distorted to take an elliptical shape whose major axis extends horizontally. On the other hand, the beam spots 6 on the vertical axis (the Y-axis) receive, by means of a barrel type vertical deflection magnetic field 12, Lorentz's forces which press the electron beams at the right side rightwards and press the electron beams at the left side leftwards. The beam spots 4 are distorted to assume an elliptical shape whose major axis extends horizontally. The side beams receive Lorentz's forces whose magnitudes are different from each other at the right side and at the left side. In addition, the directions of the Lorentz's forces exerted on the electron beam (B) and the electron beam (R) are reversed to each other. Therefore, the beam spots formed by the two side beams at the vertical en sides at the vicinity of the vertical axis assume elliptical shapes whose major axes are crossed each other. As a result, the focusing characteristic at the peripheral portion of the screen is remarkably deteriorated due to the deformation and inclination of the beam spots caused by the horizontal and vertical deflection magnetic fields. The deterioration of the focusing characteristic is a serious cause that prevents the electron gun assembly from being highly efficient.

Accordingly, such compromise must be made for designing a color cathode ray tube apparatus that the focusing characteristic of the central portion of the screen is lowered to improve the focusing characteristic of the peripheral portion of the screen, thereby obtaining a uniform focusing characteristic over the whole area of the screen.

For the auxiliary coils as described in Japanese Utility Model Publication No. Sho 57-45748, the following defects are developed. Since an electrical current flows in synchronism with the deflection current flowing in the vertical deflection coil, a magnetic field for directing the beams vertically is produced, which is directed in the horizontal direction on the horizontal axis. The beams are excessively deflected by the magnetic filed at the side of the electron gun assembly of the deflection device and likely collide with the inner wall of the neck section. This causes on the shadow a so-called neck shadow which is a portion by which no beams arrive (that is, a non-luminous portion). The auxiliary coil comprises a magnetic substance and a coil wound there around in which an electrical current flows. Thus, it is expensive as a correction element In many cases, the impedances of the deflection devices are changed according to the requests of set makers which manufacture TV sets using color cathode ray tube apparatuses. When the impedance is changed, the current flowing in the deflection coil is also changed. Therefore it is necessary to modify the specification of the auxiliary coil according to the impedance of the deflection coil, in order to produce a proper effect of the auxiliary coil on the deflection device. This hinders the mass production of the color cathode ray tube apparatuses.

SUMMARY OF THE INVENTION

The object of this invention is to provide a color cathode ray tube apparatus which renders small the distortions of the beam spots of electron beams which are caused by the deflection magnetic field produced by a deflection device thereby to reduce the deflection aberrations and which prevents the deterioration of the focusing characteristic of the peripheral portion of a screen to obtain a good focusing characteristic over the screen, and to provide a deflection device for use therein.

Characteristically, the color cathode ray tube apparatus embodied by the invention comprises the following;

a vacuum envelope which comprises a panel section, a funnel section, and a neck section., wherein the panel section consists of an axis, a face plate, an inner surface, a skirt region extending itself from peripheral edge of the face plate, and the front view which is substantially of rectangular shape; wherein the funnel section is continuously connected to the neck section, and wherein the neck section is substantially of cylindrical shape;

a phosphorous screen which is provided on the inner surface of the face plate;

a shadow mask which is disposed in the panel section by way of opposing itself from the phosphorous screen provided on the face plate;

an in-line type electron-gun assembly stored in the neck section, wherein the electron-gun assembly comprises an electron-beam generator which generates and controls three electron beams consisting of a central electron beam and a pair of both-side beams and a main electron lens section which accelerates, focuses, and converges these three electron beams;

a deflection device which comprises the first deflection coil deflecting those three electron beams emitted from the electron gun in the horizontal (X-axial) direction substantially being the in-line direction and the second deflection coil deflecting those three electron beams in the vertical (Y-axial) direction; and an eight-pole permanent magnet means which is provided in the periphery of the tubular axis between an end region of the deflection device and the main electron lens section of the electron-gun assembly, wherein the eight-pole permanent magnet generates specific magnetic field capable of minimizing deflective aberration of those three electron beams caused by deflection magnetic field of the deflection device.

The deflection device embodied by the invention is available for the color cathode ray tube apparatus incorporating the panel section, the funnel section, and the neck section internally securing the electron-gun assembly mentioned above, wherein the deflection device characteristically comprises the following; the first deflection coil which deflects those three electron beams emitted from the electron gun in the horizontal (X-axial) direction substantially being the in-line direction, the second deflection coil which deflects those three electron beams emitted from the electron gun in the vertical (Y-axial) direction, and an eight-pole permanent magnet means which is disposed in the periphery of the tubular axis between an end region of the deflection device and the main electron lens section of the electron-gun assembly, wherein the eight-pole permanent magnet generates specific magnetic field capable of minimizing deflective aberration of those three electron beams caused by deflection magnetic field of the deflection device.

The color cathode ray tube apparatus embodied by the invention characteristically incorporates a single unit of eight-pole permanent magnet disc capable of precisely positioning a plurality of magnetic poles between the end of the deflection device on the side of the electron gun and the electron gun itself. By virtue of this structural arrangement, spots of electron beams on the fluorescent surface is very close to circular shape.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

Since the color cathode ray tube apparatus embodied by the invention incorporates an eight-pole permanent magnet ring containing a plurality of magnetic poles which are precisely positioned between the electron gun and the deflection device on the side of the electron gun, the shape of electron beam spot on the phosphorous screen approximates true circle.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 15A is a longitudinal cross-sectional view of a third embodiment of the electron gun assembly according to this invention;

FIG. 15B is a front view of the electron gun assemble of FIG. 15A;

FIG. 16A is a longitudinal cross-sectional view a fourth embodiment of the electron gun assembly according to this invention;

FIG. 16B is a front view of the electron gun assembly of FIG. 16A;

DETAILED DESCRIPTION OF THE PREFERRED EMBODIMENTS

Embodiments of this invention will be explained with reference to the drawings.

Figure 1:
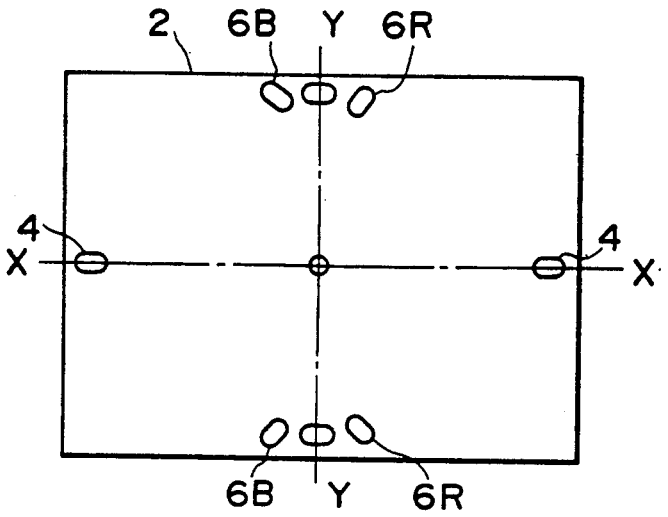
( PRIOR ART ) FIG. 1
FIG. 1 shows the shapes of the spots of the electron beams deflected in a non-uniform magnetic field produced by a conventional deflection device.
Figure 2A:
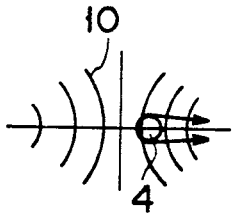
( PRIOR ART ) FIG. 2A
FIG. 2A illustrates how electron beams are exerted by forces in a pincushion type horizontal deflection magnetic field.
Figure 2B:
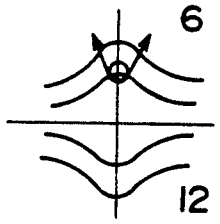
( PRIOR ART ) FIG. 2B
FIG. 2B explains how electron beams are exerted by forces in a barrel type vertical deflection magnetic field.
Figure 3:
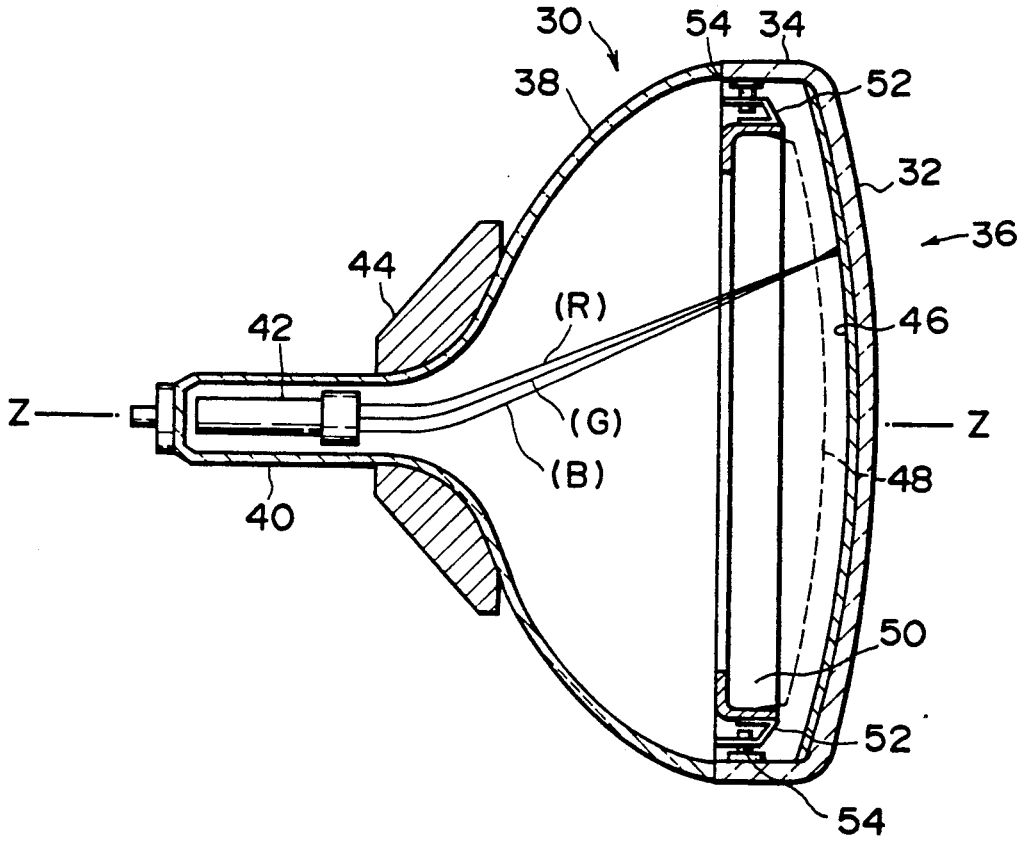
FIG. 3 is a longitudinal cross-sectional view of a color cathode ray tube apparatus according to this invention.

In FIG. 3 is shown a color cathode ray tube apparatus of self-convergence type 30, which comprises a panel section 36 having a substantially rectangular face plate 32 and a skirt 34 extending from the peripheral edge of the face plate 32, a funnel section 38 connected to the skirt 34 and a neck section 40 formed continuous to the funnel section 38. The interior of the color cathode ray tube 30 is held in a vacuum state by means of the panel section 36, the funnel section 38 and the neck section 40. Within the neck portion 40 is housed an inline type electron gun assembly 42 which generates three electron beams (R), (G) and (B) such that they fall on the same horizontal plane. On the outer periphery of the adjacent parts of the cone portion of the funnel section 38 and the neck section 40 is mounted a deflection device 44 which generates deflection magnetic fields. A phosphor screen 46 is formed on the inner face of the face plate 32 of the panel section 36. The phosphor screen 46 comprises three phosphor layers which are arranged alternately in a stripe fashion and are excited by three electron beams to emit red light, green light and blue light, respectively. Within the tube 3 is disposed a rectangular shadow mask 48 so as to face the phosphor screen 46. The shadow mask 48 is formed from a thin metal plate and is provided with a great number of slit apertures. The shadow mask 48 is used to land the three electron beams from the electron gun assembly 42 on the predetermined phosphor layers. A metallic mask frame 50 surrounds the shadow mask 48. To the mask frame 50 is welded a plurality of elastic supporting members 52 which are elastically deformable. Within the skirt 34 are provided a plurality of panel pins 54 which engage the supporting members 52.

Figure 4:
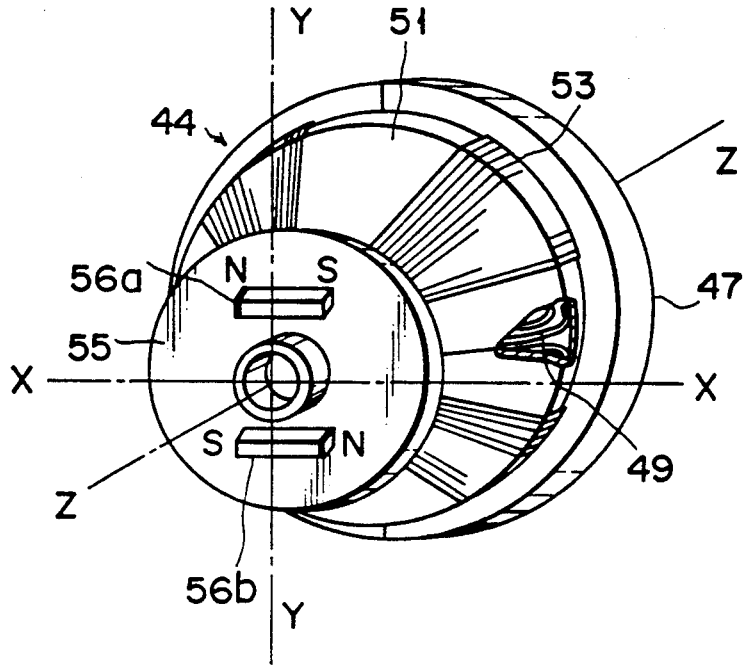
FIG. 4 is a perspective view of a deflection device according to this invention.
Figure 5:
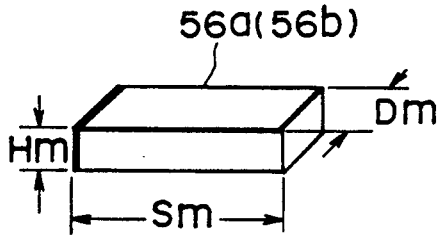
FIG. 5 is a perspective view of a permanent magnet used for this invention.

After deflected horizontally and vertically by the non-uniform magnetic field produced by the deflection device 44, the three electron beams (R), (G) and (B) radiated from the electron gun assembly 42 converge towards the slits of the shadow mask 48. The color cathode ray tube 30 is of self-convergence type. As shown in FIG. 4, the deflection device 44 comprises, for example, a pair of horizontal deflection coils 49 wound in a saddle form and mounted in a separator 47 symmetrically with respect to the horizontal axis (X-axis) and a pair of vertical deflection coils 53 wound around the core 51 and mounted on the outer face of a separator 47. The horizontal deflection coils 49 of the deflection device 44 mainly produce pincushion type deflection magnetic field which deflects the three electron beams radiated from the electron gun assembly 42 horizontally (that is, in the X directions). The vertical deflection coils 53 mainly generates a barrel type deflection magnetic field which deflects the three electron beams vertically (that is, Y directions). The color cathode ray tube 30 is provided with a pair of permanent magnets 56*a* and 56*b* on an end portion of electron gun side 55 of the deflection device 44 and which are symmetrical with respect to the central axis of the deflection device 44 (which coincides with the Z-axis) and parallel to the XY plane. The permanent magnets 56*a* and 56*b* are arranged such that their facing poles exhibit reverse magnetic polarities. Each of these magnets assumes a regular parallelepiped shape as shown in FIG. 5 and is made of oxide magnetic substance. The size of the magnet is such that Sm (length)=6 mm, Hm (thickness)=3 mm and Dm (width)=3.5 mm or the like. The magnetic flux density at the central portion of the pole surface of the magnets 56*a* and 56*b* is approximately 1500 Gauss/square centimeter.

Figure 6A:
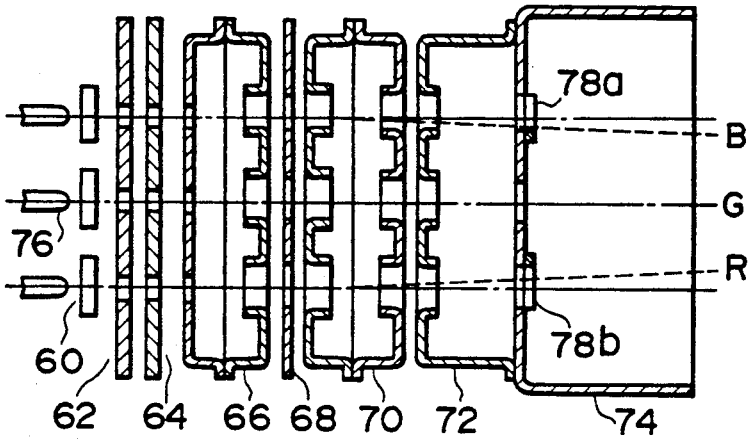
FIG. 6A is a longitudinal cross-sectional view of an electron gun assembly.
Figure 6B:
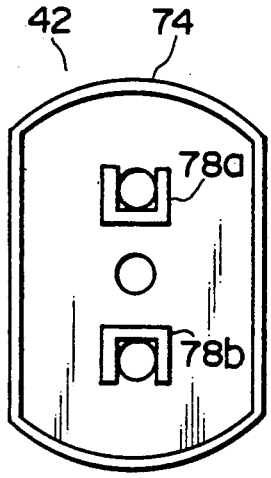
FIG. 6B is a front view of the electron gun assembly of FIG. 6A.
Figure 7:
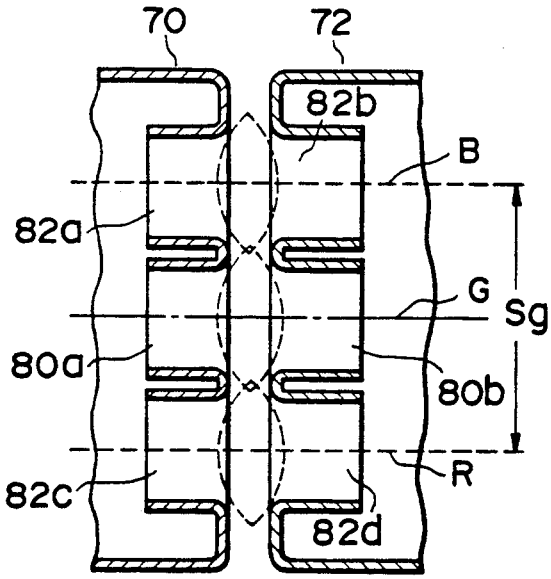
FIG. 7 is an enlarged longitudinal cross-sectional view of a part of the electron gun assembly of FIG. 6A.

In FIGS. 6A and 6B is shown the electron beam assembly 42 used in the color cathode ray tube 30. The electron beam assembly 42 comprises three independent cathodes 60 serially and horizontally arranged, a first grid 62 and a second grid 63 both used for controlling the emitted electrons to form electron beams, a third grid 66, a fourth grid 68 and a fifth grid 70 and a sixth grid 72, the grids 66, 68, 70 and 72 comprising an electron lens unit and being used for accelerating where electron beams (R) (G) and (B) and enabling them to focus, and a convergence cup 74 fixed to the grid 72. Heaters 76 are provided for heating the cathodes 60. The grids 62, 64 and 68 are formed in a plate form and have electron beam passing holes. The grids 66, 70 and 72 are formed in a hollow cylindrical electrodes of a unitary construction and have also electron beam passing holes. FIG. 7 shows the grids 70 and 72 of the electron gun assembly 42. Center beam passing holes 80*a* and 80*b* and side beam passing holes 82*a*, 82*b*, 82*c* and 82*d* are formed in the grids 70 and 72 so as to be aligned with each other, respectively. The space between the side beam passing holes or the distance Sg between a pair of side beams passing the main lens portion is approximately 6.6 mm when the length Sm of the magnet 56 is 6 mm. At peripheral portions of side beam passing holes formed in the bottom of the convergence cup 74 are disposed magnetic field controlling elements 78*a* and 78*b* made of magnetic substance for correcting comas and which have been changed the after-leakage of the magnetic field of the deflection device 44.

Figure 8:
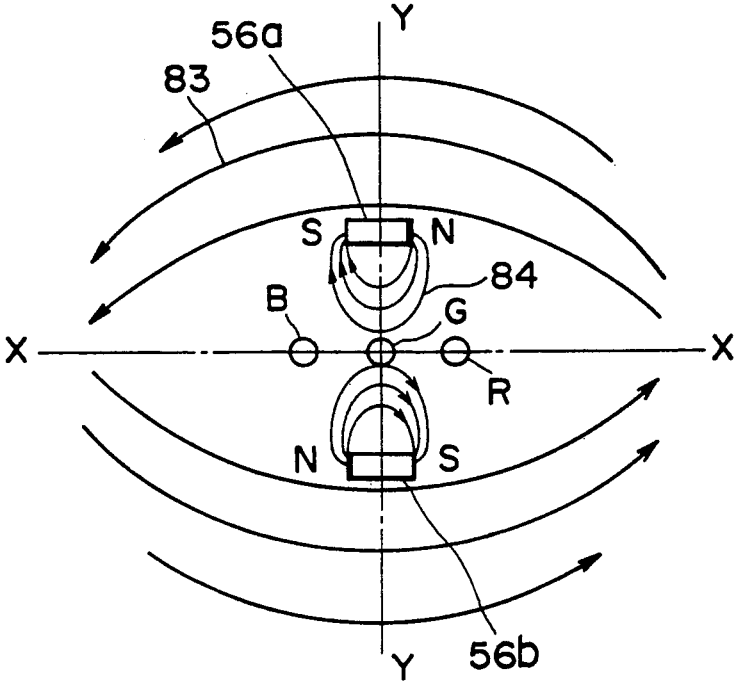
FIG. 8 shows how a pincushion type magnetic field produced by permanent magnets acts on electron beams.

The permanent magnets 56*a* and 56*b* are arranged with their reverse magnetic polarities facing each other. The distance between the poles of the magnets 56*a* and 56*b* is smaller than the distance between the paired side beams. As shown in FIG. 8, the vertical deflection coils 52 generate a barrel type vertical deflection magnetic field 83, and the magnets 56*a* and 56*b* produce a pincushion type strong magnetic field 84 in the area in which the three electron beams pass. When the magnets 56*a* and 56*b* are not used, therefore, the spots of the three electron beams on the phosphor screen assume an elliptical form with the major axis extending horizontally by Lorentz's forces due to the barrel type vertical deflection magnetic field, and the spots of the side beams are inclined. When the magnets 56*a* and 56*b* are used, however, the electron beams are exerted by vertical Lorentz's forces due to the pincushion type magnetic field, whereby the elliptical deformation and inclination of the spots are corrected.

These permanent magnets are simpler in construction and smaller than the conventional auxiliary coils. They are manufactured at a low cost and are suited for massproduction. Further, since the permanent magnets produce stationary magnetic fields, the beam spots have an improved shape over the whole screen, when the beam spots at the vicinity of the vertical axis are suitably corrected.

The magnetic correcting elements mounted on the bottom of the convergence cup 74 enables to correct the convergence in accordance with the deflection current of the deflection device and also enables the convergence or comas at the periphery of the screen to be corrected such that an improved converging characteristic obtained over the whole screen. Particularly, with a large-sized color cathode ray tube, uniform focusing and converging characteristics are required over the whole area of the screen. When auxiliary coils are used with which the adjustment of such characteristics over the whole area of the screen is difficult, it is not easy to obtain the uniform focusing and converging characteristics throughout the screen. On the other hand, the use of the permanent magnets 56*a* and 56*b* facilitates this adjustment.

Figure 9:
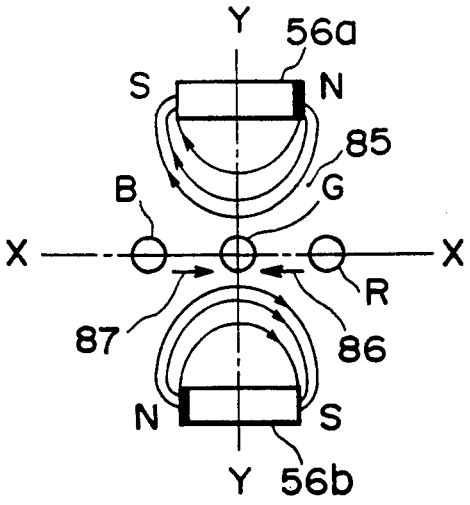
FIG. 9 illustrates a static convergence action of pincushion type magnetic fields produced by permanent magnets.

As shown in FIG. 9, a pincushion type magnetic field generated by the paired permanent magnets 56*a* and 56*b* is applied to the paired side beams. The side beams are exerted by Lorentz's forces in directions as indicated by arrows 86 and 87, respectively. By using permanent magnets having a suitable magnetic intensity, the three electron beams (R), (G) and (B) are converged on a point at the center of the screen. Thus, the static convergence characteristic is improved.

In order to establish the static convergence, the conventional electron gun assembly has the following structure:

Two adjacent grids constituting the principal lens are arranged such that the side beam passing holes formed in one grid at the side of the screen are separated from the center beam more than those of the other grid at the side of the cathode. Thus, the electrostatic lens is of asymmetrical type.

Alternately, a static electric lens formed between adjacent two grids is disposed so as to be inclined with respect to a pair of side beams.

The electron gun assembly having such a structure requires electrodes of two kinds of different shapes.

When the permanent magnets 56*a* and 56*b* according to this invention are employed, they statically converge the electron beams. Accordingly, the electron beam assembly according to this invention does not have a static convergence function and is constructed, for example, such that the three electrons are emitted in parallel to each other. The electron gun assembly constructed as described above can be manufactured at a low cost and its assembling accuracies are enhanced.

A pair of permanent magnets 56*a* and 56*b* can be used for controlling not only parallel electron beams but inclined beams when the size, the arrangement and the intensity of magnetic fields of the permanent magnets are properly selected.

Figure 10:
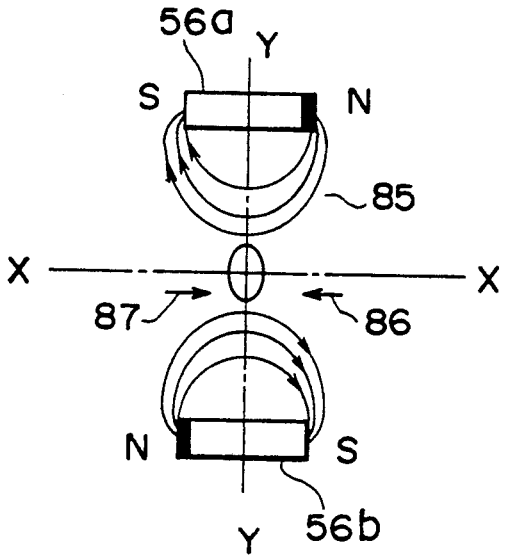
FIG. 10 explains an irrotational symmetrical lens function of a pincushion type magnetic field produced by a pair of permanent magnets.
Figure 11:
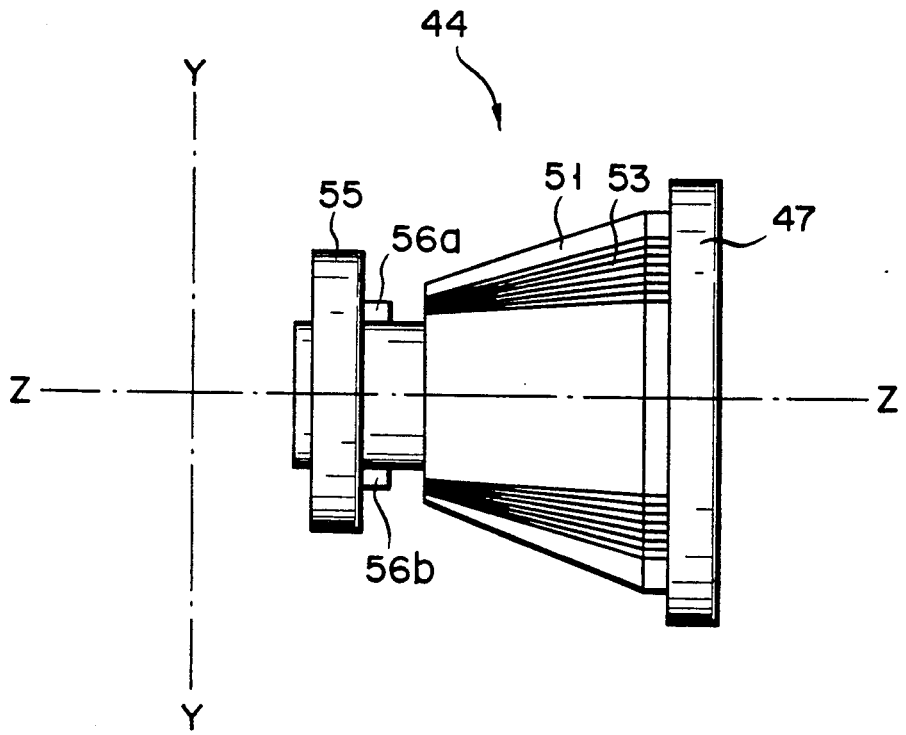
FIG. 11 is a side view of a modification of the first embodiment of the deflection device.

Referring to FIG. 10, an electron beam is applied to by a pincushion type strong magnetic field 85 produced by a pair of permanent magnets 56*a* and 56*b*. Then, the beam spot is exerted by Lorentz's forces and is deformed into an elliptical shape with its major axis extending vertically (that is, In the Y directions). Thus, these permanent magnets function as an irrotational symmetrical lens which deforms the electron beams into an elliptical form. Therefore, the electron gun assembly should not use an irrotational symmetrical type lens but a rotational symmetrical type lens, whereby it is manufactured at a low cost and has an improved reliability. The distance between the poles, the intensity of magnetization, the shape and the like of the paired permanent magnets are arbitrarily selected. Then, the permanent magnets are rendered small and disposed at more places than the auxiliary coils. For example, the permanent magnets can be placed between the electron gun side portion of the deflection device and the core. A deflection device having these permanent magnets is shown in FIG. 11. The permanent magnets 56*a* 56*b* are arranged between the deflection device 44 and the electron gun assembly 42.

Figure 12:
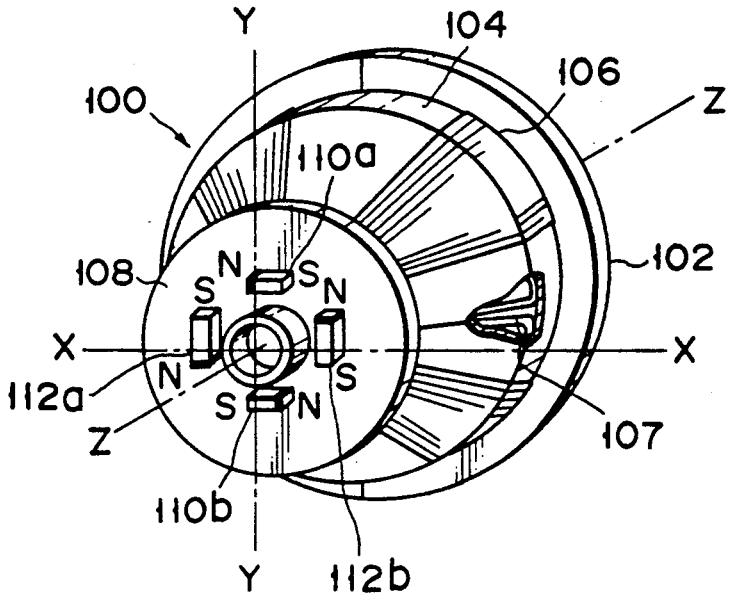
FIG. 12 is a perspective view of a second embodiment of the deflection device according to this invention.

There will now be explained the second embodiment which is also used in an inline color cathode ray tube of self convergence type like the first embodiment. As shown in FIG. 12. a deflection device 100 of the second embodiment comprises a pair of horizontal deflection coils 107, for example, wound in a saddle form and mounted in a separator 102 symmetrically with respect the X-axis, and a pair of vertical deflection coils 106 wound around the core 104 and mounted on the outer face of the separator 102. The horizontal deflection coil 107 mainly generates a pincushion type deflection field for deflecting horizontally (in the X direction) the three electron beams emitted from the electron gun assembly. The vertical deflection coil 106 produces mainly a barrel type deflection magnetic field for deflecting the three electron beams in the direction (the Y direction) perpendicular to the direction in which the three electron beams are arranged. On the electron gun side portion 108 of the deflection device 100, a pair of permanent magnets 110*a* and 110*b* are mounted symmetrically with respect to the central axis (that is, the Z-axis) and are disposed in parallel to the XZ plane with their middle portions located on the Y-axis; and, similarly, a pair of permanent magnets 112*a* and 112*b* are mounted symmetrically with respect to the central axis and are disposed in parallel to the YZ plane with their middle portions located on the X-axis). The permanent magnets 110*a*, 110*b*, 112*a* and 112*b* are rectangular and are made of oxide magnetic substance. The magnetic flux density at the central portion of the pole surfaces of the permanent magnets 110*a* and 110*b* is 1500 Gauss/square centimeter, while those of the permanent magnets 112*a* and 112*b* is 1300 Gauss/square centimeter.

The permanent magnets 110*a* and 110*b* arranged as described above generates a pincushion type strong magnetic field, in addition to a barrel type vertical deflection magnetic field generated by the vertical deflection coils. The electron beams are exerted not only by the Lorentz's forces due to the barrel type magnetic field but also by the Lorentz's forces which deform the spots of the electron beams into an elliptical shape with their major axis extending vertically. As a result, the beam spots are prevented from being deformed on the screen into an elliptical form with their major axis extending horizontally, and the inclination of the spots of the paired side beams is also avoided.

Figure 13:
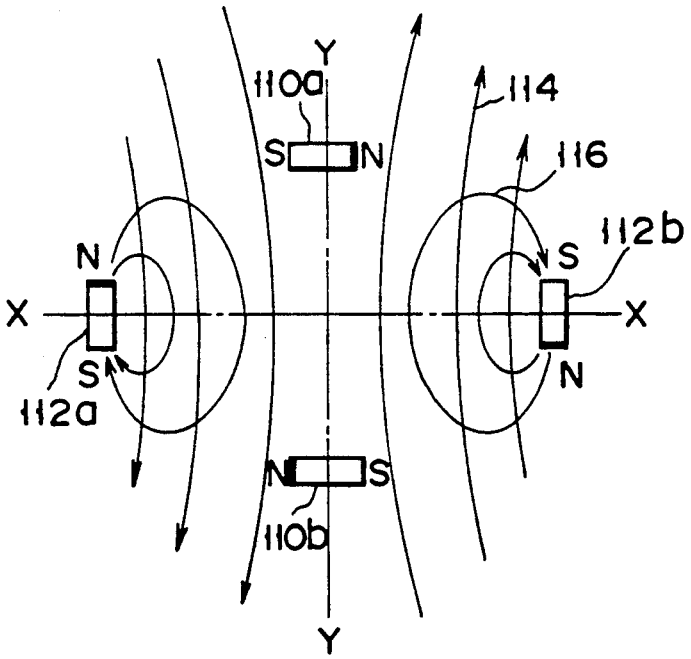
FIG. 13 shows how a pincushion type magnetic field acts which is produced by magnets arranged on both sides in this figure.
Figure 14:
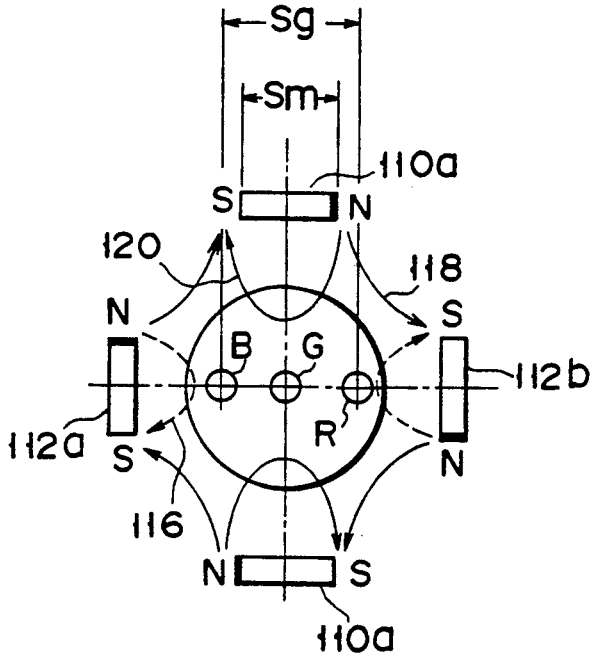
FIG. 14 explains how a pincushion type magnetic field acts which is produced by two pairs of magnets.

In FIG. 13, the pair of the permanent magnets 112*a* and 112*b* generate a pincushion type magnetic field 116 directed in the same direction of the horizontal deflection magnetic field 114 produced by the horizontal deflection coils 107. As shown FIG. 14, magnetic field 118 is generated between the magnets 112*a* and 112*b* as one party and the magnets 110*a* and 110*b* as the other party. The magnetic field 118 exerts Lorentz's forces in the directions opposite to those in which the paired side beams are inclined due to the vertical deflection magnetic field, so as to effectively compensate the inclination of the spots.

It is preferred that the length Sm of the permanent magnets 110*a* and 110*b* should be shorter than the distance Sg between the side beams in order to effectively act the magnetic field 118 on the paired side beams. In this arrangement, a pair of side beams approach the center beam by the pincushion type magnetic field generated by the permanent magnets 110*a* and 110, while the side beams are separated from the center beam by the pincushion type magnetic field generated by the permanent magnets 112*a* and 112*b*. Therefore, the deflection device 100 cooperates with an electron gun assembly which is different from the first embodiment of the electron gun assembly and is inclined so that the side beams are directed to the center of the phosphor screen 46.

Like the first embodiment, comas are reduced by correcting the converging characteristic at the periphery of the screen by means of the electron gun assembly. Further, the distances of the permanent magnets, the intensities of magnetization and shapes of the magnets are selected without any limitations. In other words, since the magnets can be set at various places, the deflection device can be made small.

FIGS. 15A and 15B show a third embodiment of this invention in which an electron gun assembly is provided with permanent magnets. The electron gun assembly 150 of this invention comprises three independent cathodes 152 arranged in parallel to each other on a horizontal plane including the X-axis, an electron beam generator having a first grid 154 and a second grid 156 both for controlling electrons emitted from the cathodes 152, and a lens unit having a third grid 158 and a fourth grid 160 both for accelerating and focusing three electron beams emitted from the electron beam generator. The electron gun assembly 150 is of bipotential type and has a convergence cup 164 connected to the fourth grid 160. Magnetic field control elements 166*a* and 166*b* made of magnetic substance surround side beam passing holes formed in the bottom of the convergence cup 164. Within the convergence cup 164 are arranged a pair of permanent magnets 168*a* and 168*b* symmetrically with respect the central axis 162 (Z-axis) of the electron gun assembly 150 such that their facing poles have opposite polarities. The distance between the poles of each permanent magnet is smaller than the distance between the side beams. With the third embodiment, the same technical advantages are obtained as with the first embodiment.

FIGS. 16A and 16B show a fourth embodiment of this invention in which a bipotential type electron gun assembly similar to that used in the third embodiment is employed. The electron gun assembly 170 comprises cathodes 172, a first grid 174, a second grid 176; a third grid 178, a fourth grid 180 and a convergence cup 182.

On the bottom of the convergence cup 182 are mounted magnetic field control elements 186*a* and 186*b* made of magnetic substance. Two pairs of permanent magnets 188*a* and 188*b* and 190*a* and 190*b* are arranged symmetrically with respect to the central axis 184 (Z-axis) of the electron gun assembly 180 within the convergence cup 182 such that the facing poles of each pair of the permanent magnets have reverse polarities. The magnets 188*a* and 188*b* are arranged in parallel to the XZ plane, whereas the magnets 190*a* and 190*b* are arranged in parallel to the YZ plane. The length of the vertical permanent magnets 188*a* and 188*b* is smaller than the distance between a pair of side beams which have passed the electron lens unit. The magnetic flux density of the pole surface of the permanent magnets 188*a* and 188*b* is larger than that of the permanent magnets 190*a* and 190*b*. As a result, the magnets 188*a* and 188*b* generate a strong pincushion magnetic field than the magnets 190*a* and 190*b*. With the fourth embodiment, the same technical advantages are obtained as with the second embodiment.

The permanent magnets are mounted on the inner periphery of the convergence cup in the third and fourth embodiments. However, they can be arranged on the grids which form the lens unit of the electron gun assembly. When, however, the pincushion type magnetic field produced by the permanent magnets are subject to the lens unit of the electron gun assembly, the side beams do not pass the center of the lens unit, and coma aberration occur. Therefore, it is necessary to provide permanent magnets on the lens unit in order to eliminate the effect of the pincushion type magnetic field produced by the permanent magnets.

This invention is not limited to the above-mentioned embodiments but is applicable to color cathode ray tubes or color cathode ray tube apparatuses having electron gun assemblies. The magnetic control elements are not limited to those of the embodiments and can assume various shapes according to the kinds of the color cathode tubes and/or the deflection devices.

Next, the fifth embodiment of the invention is described below.

Figure 17:
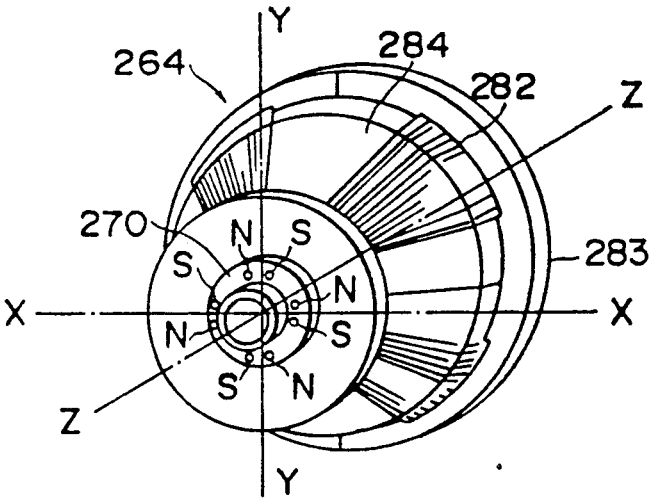
FIG. 17 is a perspective view of the deflection device of the color cathode ray tube apparatus embodied by the invention.

FIG. 17 designates the color cathode ray tube apparatus according to the fifth embodiment of the invention. Except for the deflection device, the color cathode ray tube apparatus of the fifth embodiment uses those component members exactly identical to those which are made available for the preceding embodiments.

FIG. 17 is an enlarged perspective view of the deflection device 264, which incorporates a pair of saddle-type horizontal deflection coils 280 symmetrically being disposed in the vertical (Y-axial) direction of a separator 283 and a pair of troidal-type vertical deflection coils 282 wound on a core 284, respectively. Synchronized currents each having a different value compatible with those deflection coils 280 and 283 are respectively delivered to passive circuits (not shown) which incorporates those elements like resistors and line concentrators. The ring-shaped permanent magnet 270 secured to the deflection device 264 on the side of the electron-gun assembly 262 is integrally provided with eight magnetic poles in the periphery of the tubular axis Z.

Figure 18A:
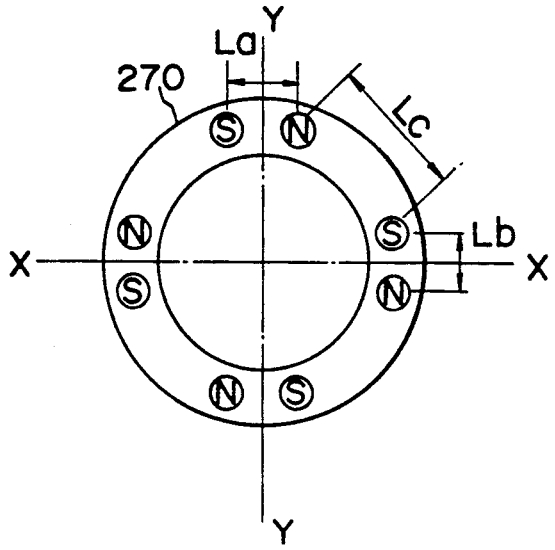
FIGS. 18A and 18B are plans designating an eight-pole permanent magnet provided for the deflection device shown in FIG. 17.
Figure 18B:
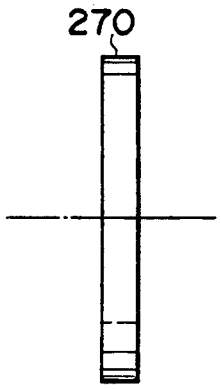

As shown in FIG. 18A and 18B, those eight magnetic poles provided fro the permanent magnet 270 are alternately disposed. The intervals provided between these magnetic poles which are disposed at specific positions close to both sides of the axes X and Y are substantially narrower than those intervals between those magnetic poles which are apart from those axes X and Y. In addition, those two pairs of magnetic poles, in other words, four magnetic poles, which are disposed at specific positions close to both sides of the axis X respectively contain magnetic force being equal to each other. Likewide, those two pairs of magnetic poles (i.e., four magnetic poles) which are disposed at specific positions close to both sides of the axis Y also contain magnetic force being equal to each other. On the other hand, those two pairs of magnetic poles (i.e., four magnetic poles) which are disposed at those positions close to both sides of the axis X respectively contain such magnetic force weaker than that is held by those two pairs (i.e., four magnetic poles) of magnetic poles disposed at those positions close to both sides of the axis Y. When viewing from the phosphorous screen and assuming the presence of plan relied by the axes X and Y, these magnetic poles alternately invert themselves clockwise based on the N-pole which is made of the magnetic pole closest to the axis Y in the first quadrant at the upper right position.

Next, an actual example of the permanent magnet disc 270 is described below. Actually, the permanent magnet ring 270 has 30 mm of inner diameter, 33 mm of outer diameter, 5 mm of width, 6 mm of intervals La between those magnetic poles intersecting the axis Y, 5 mm of intervals Lb between those magnetic poles intersecting the axis x, and 26.5 mm of intervals Lc between those magnetic poles which do not intersect normal axis, respectively. This embodiment provides 1.300 Gauss per centimeter of superficial flux density for those magnetic pole intersecting the axis X, and provides 1,500 Gauss per centimeter of the superficial density for those magnetic poles intersecting the axis Y, respectively.

Figure 28:
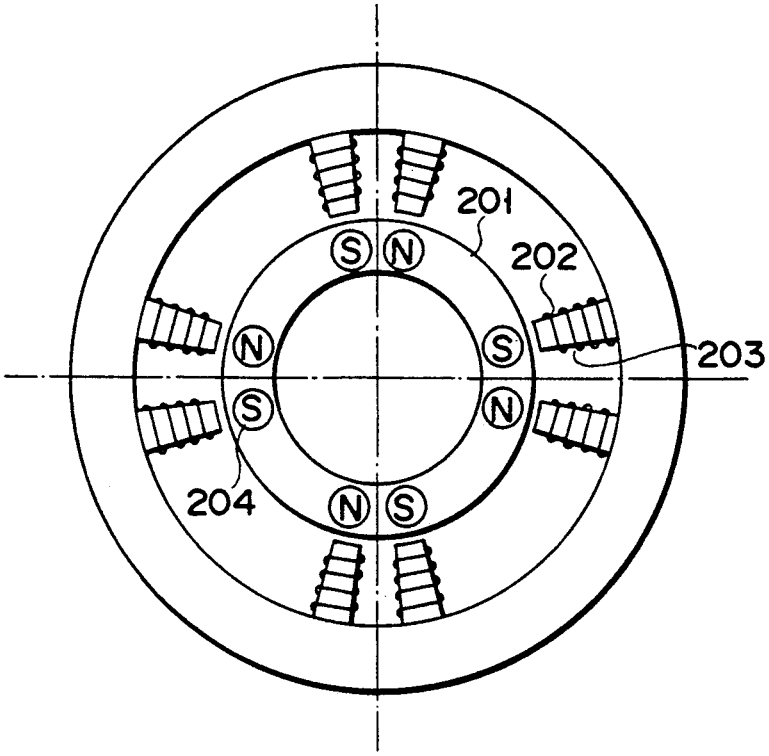
FIG. 28 is a plan designating a magnetizing apparatus and a magnetic material.

FIG. 28 shows magnetizing method of the permanent magnet having eight magnetic poles. A magnetizing apparatus having eight cores 202 and eight coils 203 is arranged around a ring-shaped magnetic material 204. Electric current is provided for coils 203, so that eight magnetic poles are formed on magnetic material 204. As eight cores 202 is correctly positioned on magnetizing apparatus eight magnetic poles are formed on magnetic material 204 correctly. Furthermore, the strength of magnetic filed can be changed by current strength and winding times of the coil. In other method, magnetizing apparatus can be positioned on inside of ring-shaped magnetic material 204.

Figure 19A:
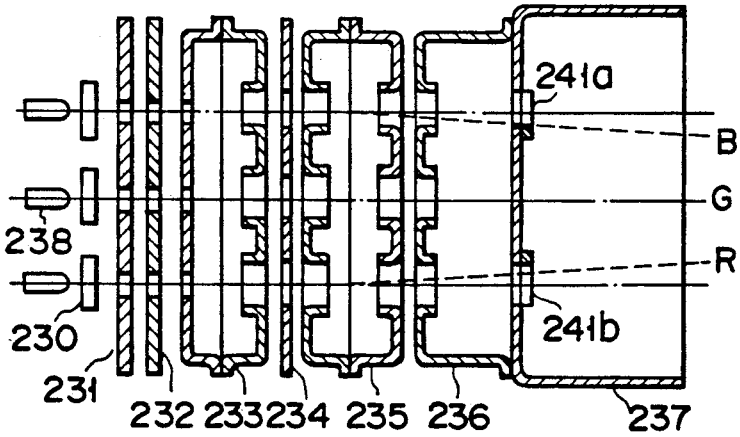
FIGS. 19A and 19B are sectional views of the electron-gun assembly of the color cathode ray tube apparatus embodied by the invention.
Figure 19B:
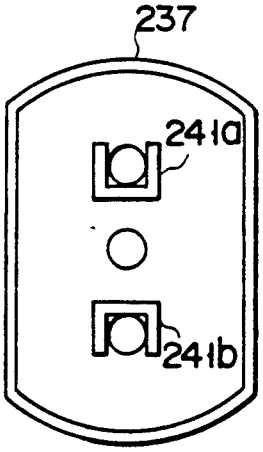

As shown in FIG. 19A and 19B, the electron gun assembly 262 of the color cathode ray tube apparatus embodied by the invention incorporates the following; three units of independent cathodes 230 which are aligned on a rank in horizontal direction, an electron beam generator GE consisting of the first and second grids 231 and 232 which respectively control electrons emitted from those independent cathodes 230, and an electron lens section consisting of the third through sixth grids 233 through 236 which respectively accelerate and focus those three electron beams R, G, and B, emitted from the electron beam generator GE.

A convergence cup 237 is provided for the sixth grid 236. A heater 238 is provided in order to heat those three independent cathodes 230. Those first, second and the fourth grids 231, 232, and 234, are substantially plate like electrodes which are respectively provided with three through-holes allowing permeation of electron beams emitted from those three independent cathodes 230. On the other hand, the third, fifth, and the sixth grids 233, 235, and 236, are respectively the integrally structured cylindrical electrodes which are respectively provided with three through holes to allow permeation of electron beams emitted from those three independent cathodes 230.

In contrast with the intervals (La=6 mm) provided between those S-poles and N-poles of the permanent magnet disc 270, the intervals between those through holes allowing permeation of a pair of side electron beams, concretely, those intervals Sg between the aligned direction of a pair of side electron beam passing through the main lens section are adjusted to about 6.6 mm. In addition, a magnetic field control element consisting of those magnetic members 241*a* and 241*b* affecting each other between the magnetic field leaked from the rear region of the deflection device is provided in the periphery of the side-beam permeating holes at the bottom of the convergence cup 237. The magnetic field control element compensates for the coma aberration.

By virtue of the provision of the disc-shaped permanent magnet 270 for the deflection device 264 on the side of the electron gun assembly 262, a variety of advantageous effects can be achieved, which are described below.

Figure 20:
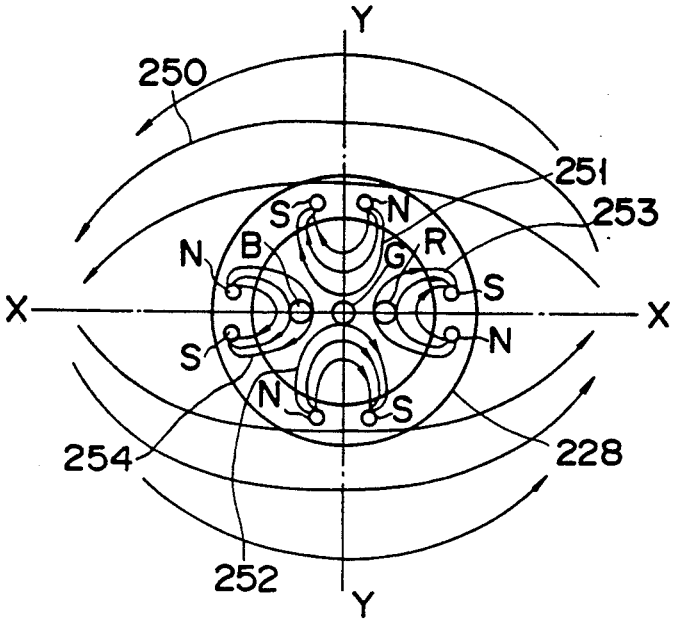
FIG. 20 is a plan designating distribution of magnetic filed in the periphery of the eight-pole permanent magnet provided for the color cathode ray tube apparatus embodied by the invention.
Figure 21:
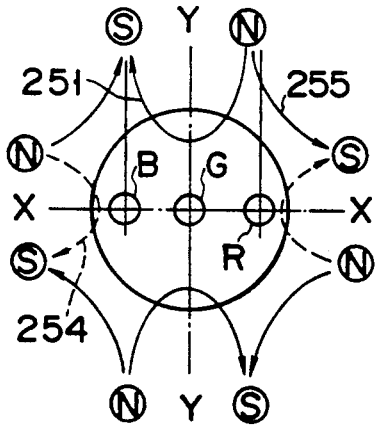
FIG. 21 is a plan designating distribution of magnetic filed in those regions neighboring the eight-pole permanent magnet provided for the color cathode ray tube apparatus embodied by the invention.

As shown in FIG. 20, a pair of vertical deflection coils 282 respectively generate extremely intense barrel-like vertical deflection magnetic field 250. As a result, extremely intense Lorentz's force affects electron beams, and thus, all the electron beams are compulsorily subject to severe distortion. In order to minimize adverse effect of the intense barrel-like vertical deflection magnetic filed 250 affecting electron beams, those magnetic poles on both sides of those regions intersecting the axis Y respectively generate intense pin-cushion type magnetic fields 251 and 25 which are inverse form the barrel-like vertical deflection magnetic field 250 so that the intense Lorentz's force can eventually be offset. As a result. those adverse phenomena like elliptical distortion of beam spots of those three electron beams and inclination of those side electron beams against the horizontal direction are effectively eliminated.

Like the one taking place in the Y-axial direction, those magnetic poles on both sides of those regions intersecting the axis X respectively generate intense pin-cushion type magnetic fields 253 and 254. Furthermore, in order to minimize adverse influence of the intense barrel-like vertical deflection magnetic field 250 affecting those side beams, those magnetic poles on both sides of those regions not intersecting axes X and Y respectively generate the other magnetic field 155 which consequently generates specific Lorentz's force inverse from the one generated by the barrel-like vertical deflection magnetic field 250. As a result, the preceding Lorentz's force is offset, thus canceling the inclination of those side beams against the horizontal direction.

To effectively promote useful effect of the magnetic field in favor of those side electron beams, it is suggested that the intervals La be provided between those magnetic poles on both sides of the axis Y by way of being narrower than the intervals Sg provided for a pair of those side beams in the aligned direction.

In contrast with the color cathode ray tube added with the auxiliary coil described in the preceding Japanese Laid-Open Utility Model Publication No. 57-45748 of 1982, the permanent magnet disc 270 embodied by the invention easily corrects spots of those three electron beams, and in addition, owing to its compact size, the permanent magnet ring 270 is inexpensive and promotes workability for implementing the mass production. The preceding color cathode ray tube apparatus added with the auxiliary coil cited above fluctuates the deflection magnetic field by effect of deflection current, and thus, when compensating for the spot shape of those three electron beams by applying the added auxiliary coil, depending on the position of electron beams, correction effect may become too short or excessive.

On the other hand, when applying the color cathode ray tube apparatus using the permanent magnet disc 270 embodied by the invention, the apparatus can stably correct magnetic field all the time. In other words, neither shortage nor excess occurs in the effect of correcting the beam spot shape irrelevant of the position of the electron beams. As a result, electron beam spot can constantly be shaped into perfectly circular form all over the phosphors screen.

When magnetizing any conventional bar-shaped permanent magnet, the line of magnetic force may deviate itself from the correct direction, and as a result, the magnetic poles cannot be set to correct positions. On the other hand, since the permanent magnet ring 270 embodied by the invention can discretely provide a plurality of magnetic poles, all the magnetic poles can precisely be set to the predetermined positions. As a result, the disc-shaped permanent magnet 270 embodied by the invention can easily generate axially symmetrical corrective magnetic filed, thus eventually achieving improved focus characteristic without causing the convergence characteristic to be lowered.

Figures 22A, 22B, 22C:
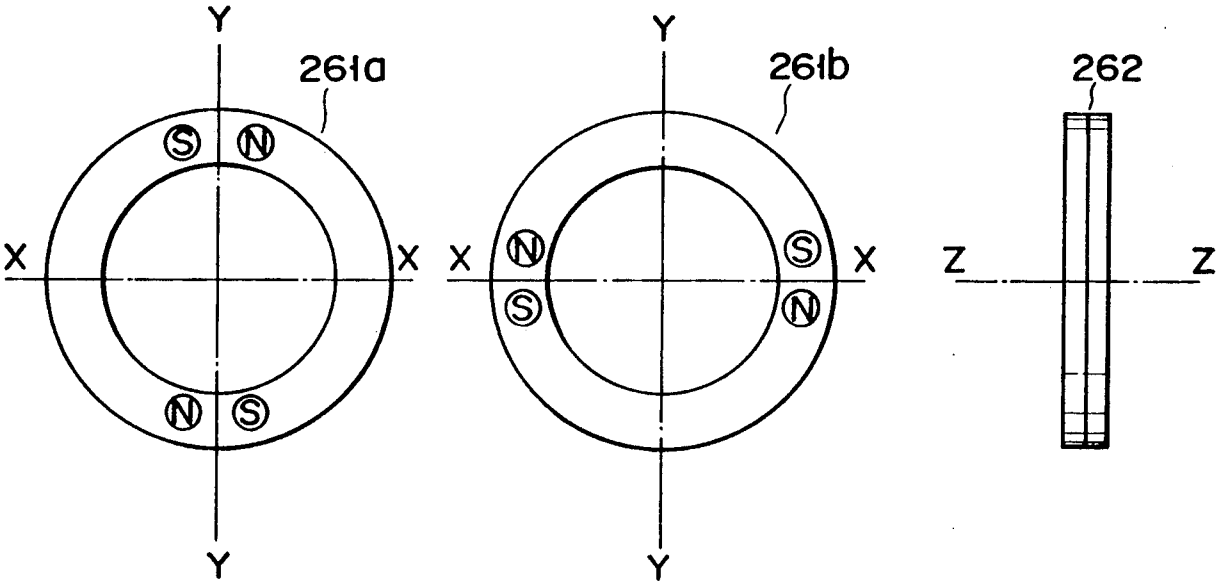
FIGS. 22A through 22C are respectively the plans designating the eight-pole permanent magnets of the deflection device of the color cathode ray tube apparatus according to the second embodiment of the invention.

FIG. 22 designates the second embodiment of the permanent magnet disc 270. Except for the ring-shaped permanent magnet 270 introduced to the first embodiment, the second embodiment uses those components exactly identical to those of the first embodiment. The second embodiment provides a pair of permanent magnet members for making up an integral permanent magnet disc. Concretely, those permanent magnet members 261*a* and 261*b* are respectively provided with four magnetic poles. These four magnetic poles provided for each of these permanent magnet members 261*a* and 261*b* are symmetrically positioned, which are conjunctionally united to complete a disc-shaped permanent magnet 262 like the one provided for the first embodiment. The complete permanent magnet disc 262 yields satisfactory effect identical to that is generated by the disc-shaped permanent magnet 270 of the first embodiment.

Figure 23A:
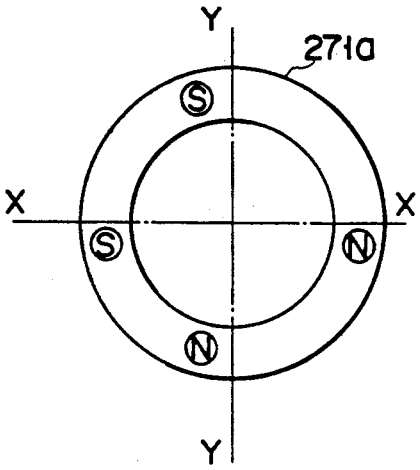
FIGS. 23A through 23C are respectively the plans designating modified examples of the eight-pole permanent magnet of the deflection device according to the second embodiment.
Figure 23B:
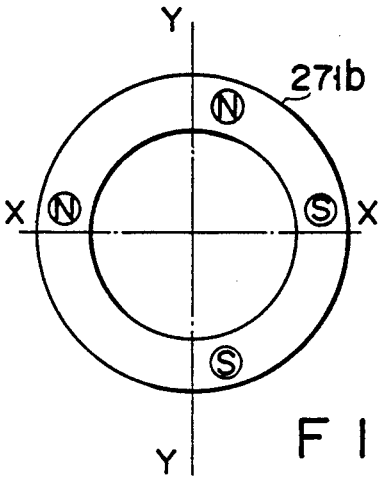
Figure 23C:
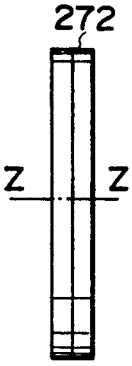
Figure 24A:
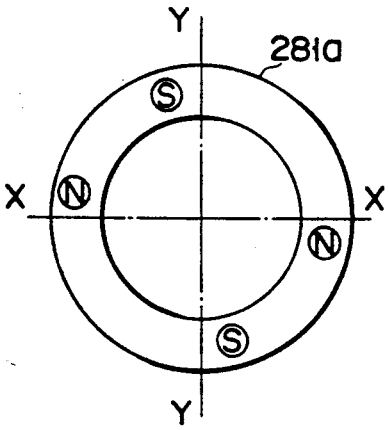
FIGS. 24A through 24C are respectively the plans designating other modified examples of the eight-pole permanent magnet of the deflection device according to the second embodiment.
Figure 24B:
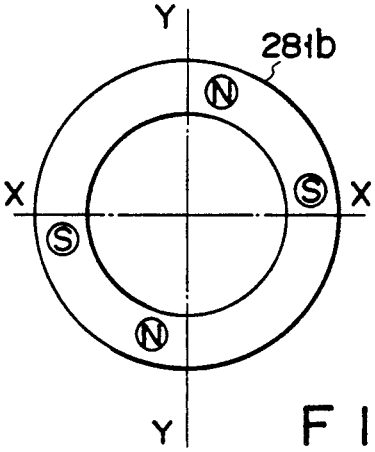
Figure 24C:
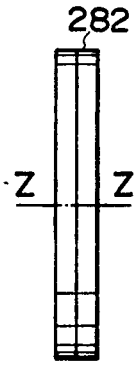

FIGS. 23 and 24 respectively designate modified examples of the permanent magnet 262 of the second embodiment. To execute this modification, those magnet poles on a pair of permanent magnet member 271*a* and 271*b* and another pair of permanent magnet members 281*a* and 281*b* are positioned apart from each other in the structure of those permanent magnets 272 and 282. Provision of these magnetic poles at discrete positions minimizes mutual interference of those magnetic poles to effectively promote magnetization. It should be understood that the scope of the second embodiment does not solely specify the number of applicable permanent magnet to be only two pieces, but a minimum of three permanent magnet members may also be introduced as well.

Figure 25:
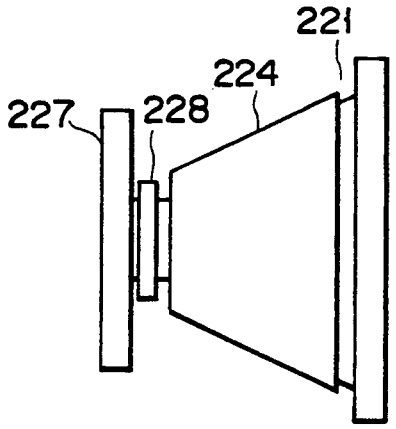
FIG. 25 is a plan designating another modified example of the eight-pole permanent magnet of the deflection device according to the third embodiment of the invention.
Figure 26:
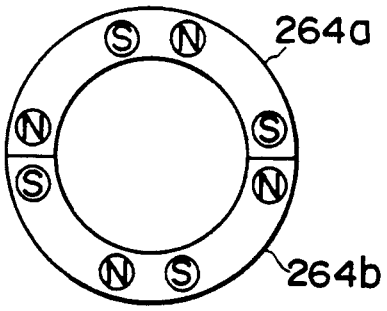
FIG. 26 is a plan designating a still further modified example of the eight-pole permanent magnet of the deflection device according to the third embodiment of the invention.
Figure 27B:
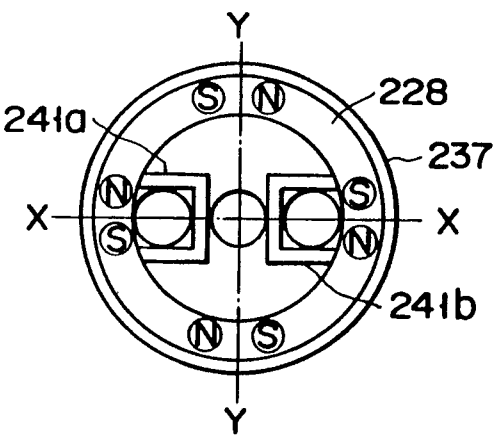
FIG. 27B is a plan designating an electron-gun assembly according to the fourth embodiment.
Figure 27A:
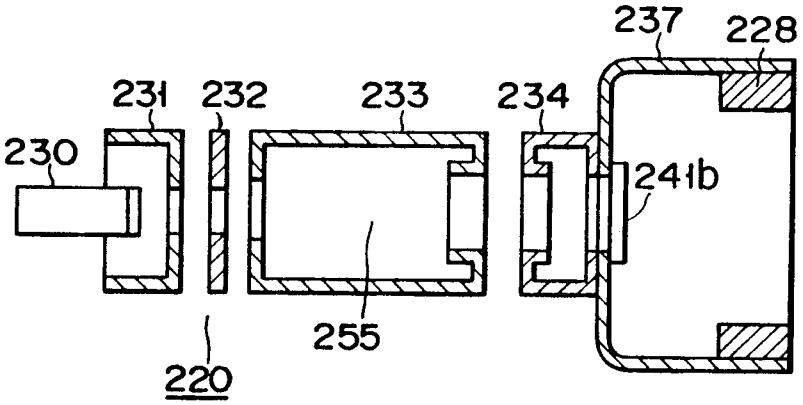
FIG. 27A is a sectional view of an electron-gun assembly according to the fourth embodiment.

The above first and second embodiments respectively provided the ring-shaped permanent magnet at a specific position corresponding to an end of the electron gun. On the other hand, the third embodiment shown in FIG. 25 secures the permanent magnet disc 228 between the core 224 and the rear end region 227 of the electron gun. To introduce the third embodiment, as shown in FIG. 26, the ring-shaped permanent magnet may also be composed of a pair of semicircular shaped permanent magnet members 264*a* and 264*b* in union. Nevertheless, it is of course possible for the third embodiment to provide the permanent magnet disc which can be composed of three or more than three of component members instead of merely specifying the available number to be only two pieces of permanent magnet member. The same also applied to the second embodiment as well.

The first, second and the third embodiments respectively secure the permanent magnet disc to the deflection device. The invention provides another embodiment which directly installs the permanent magnet disc to the electron-gun assembly 220. The electron-gun assembly 220 comprises the following; three independent cathodes 230 which are aligned on a rank in the horizontal direction, an electron beam generator incorporating the first and second grids 231 and 232 which respectively control electron beam emitted from those three independent cathodes 230, and an electron lens section incorporating the third and fourth grids 233 and 234 which respectively accelerate and focus those three electron beams emitted from the electron beams generator. In addition, a magnetic field control element consisting of a pair of magnetic members 241*a* and 241*b* is installed in the periphery of the side-beam permeating through holes at the bottom of the convergence cup 237 secured to the fourth grid 234. The permanent magnet disc 228 is secured to the internal surface of the convergence cup 237, where the permanent magnet ring 228 generates eight-pole magnetic field which is symmetrical of both sides of the center axis 255 of the electron gun assembly 220.

According to this structural arrangement, the permanent magnet ring 228 substantially makes up a region allowing permeation of electron beams on the side of the electron gun assembly 220 of the deflection device, and yet, the permanent magnet disc 228 may be installed to a position much closer to the deflection device than the electron lens section of the electron gun assembly 220.

It should be understood that the whole substance of the permanent magnet disc may not necessarily be magnetic, but the magnetism may merely be present in those regions accommodating those magnetic poles. Needless to say that the process for magnetizing the magnetic members shall precede the process for installing the color cathode ray tube to the apparatus.

The color cathode ray tube apparatus embodied by the invention incorporates an electron gun which emits three electron beams aligned on a rank and a deflection device which generates deflected magnetic field deflecting those three electron beams emitted from the electron gun in the aligned direction and in the direction orthogonally intersecting the aligned direction. The ring-shaped permanent magnet generating eight-pole magnetic field is disposed at a position on the side of the electron gun of the deflection device or at a position close to electrons on the side of the phosphorous screen of the main lens section of the electron gun assembly. The circular permanent magnet disc easily promotes magnetization of magnetic poles, and yet, the permanent magnet disc itself is integrated with those magnetic poles which are precisely magnetized and secured to the predetermined positions, and as a result, the permanent magnet disc correctly generates eight-pole magnetic field in perfect symmetry. By virtue of the above structural advantage, by effectively applying precisely controlled magnetic field generated by the permanent magnetic disc, deflective aberration affecting those electron beams from the deflection magnetic field generated by the deflection device can fully be corrected. As a result, the focus characteristic is securely promoted in the periphery of the phosphor screen.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode ray tube apparatus comprising:

a vacuum envelope comprising a panel section, a funnel section, and a neck section; wherein said panel section comprises an axis, a face plate, an inner surface, a skirt region extending itself from a peripheral edge of said face plate, and a front view which is substantially of rectangular shape; wherein said funnel section is continuously connected to said neck section, and wherein said neck section is substantially of cylindrical shape;

a phosphorous screen which is provided on the inner surface of said face plate;

a shadow mask which is disposed in said panel section opposing said phosphorous screen provided on said face plate;

an in-line type electron gun assembly which is stored in said neck section, wherein said electron gun assembly comprises an electron beam generator which generates and controls three electron beams, including a central electron beam and two pairs of side electron beams and a main electron lens section which accelerates, focuses, and converges said three electron beams; and a deflection device comprising a first deflection coil which deflects said three electron beams emitted from said electron gun assembly in an in-line direction substantially in the horizontal direction and a second deflection coil which deflects said three electron beams in the vertical (Y-axial) direction;

an eight-pole permanent magnet means which is provided in the periphery of tubular axis between an end region of said deflection device and said main electron lens section of said electron gun assembly, and wherein said eight-pole permanent magnet means generates a specific magnetic field capable of minimizing deflective aberration of said three electron beams caused by deflected magnetic field of said deflection device, wherein a specific magnetic flux density of two pairs of magnetic poles of said eight pole permanent magnet means, which two pairs are disposed at specific positions close to both sides of a Y axis direction of said eight-pole permanent magnet means is larger than a specific magnetic flux density of an other two pairs of magnetic poles, which other two poles are disposed at specific positions close to both sides of an X axis of said eight-pole permanent magnet means.

2. A color cathode ray tube apparatus according to claim 1, wherein said eight-pole permanent magnet means is formed in a circular doughnut-like shape.

3. A color cathode ray tube apparatus according to claim 1, wherein said eight-pole permanent magnet is substantially composed of a plurality of circular doughnut-like plates.

4. A color cathode ray tube apparatus according to claim 1, wherein said eight-pole permanent magnet means is formed in a circular doughnut-like shape which is splittable into a plurality of component members.

5. A color cathode ray tube apparatus according to claim 1, wherein intervals between two pairs of magnetic poles which are disposed at specific positions close to both sides of axis X of said eight-pole permanent magnet means and intervals between the other two pairs of magnetic poles disposed at specific positions close to both sides of axis Y of said eight-pole permanent magnet means are respectively narrower than those intervals between four pairs of magnetic poles which are apart from said axes X and Y.

6. A color cathode ray tube apparatus according to claim 1, wherein said two pairs of magnetic poles are disposed at specific positions close to both sides of axis Y which are narrower than an interval between a pair of said side electron beams emitted from said electron gun assembly.

7. A color cathode ray tube apparatus according to claim 1 wherein, viewing said eight-pole permanent magnet means from said phosphorous screen, N-pole is the magnetic pole closest to 25 axis X in a clockwise direction.

8. A color cathode ray tube apparatus according to claim 1, wherein said eight-pole permanent magnet means generates a pin-cushion type magnetic field which is capable of minimizing deflective aberration of electron beams caused by another magnetic field generated by said second deflection coil of said deflection device.

9. A color cathode ray tube apparatus as in claim 1, wherein said two pairs of magnets close to the X-axis are shorter than a distance between the side beams.

10. A deflection device for a color cathode ray tube apparatus comprising a panel section, a funnel section, and a neck section internally securing an electron-gun assembly, wherein said deflection device comprises:

a first deflection coil which deflects three electron beams including a central beam and side beams emitted from said electron-gun assembly in the in-line direction substantially in the horizontal (X-axis) direction; and a second deflection coil which deflects said three electron beams emitted from said electron-gun assembly in the vertical (Y-axis) direction;

an eight-pole permanent magnet means which is provided in the periphery of a tubular axis between an end region of said deflection device and said main electron lens section of said electron-gun assembly, and wherein said eight-pole permanent magnet means generates a specific magnetic field capable of minimizing deflective aberration of said three electron beams caused by deflected magnetic field of said deflection device;

wherein a specific magnetic flux density of two pairs of magnetic poles of said eight pole permanent magnet means, which two pairs are disposed at specific positions close to both sides of a Y axis direction of said eight-pole permanent magnet means is larger than a specific magnetic flux density of an other two pairs of magnetic poles, which other two poles are disposed at specific positions close to both sides of an X axis of said eight-pole permanent magnet means.

11. A color cathode ray tube apparatus according to claim 10, wherein said eight-pole permanent magnet means is formed in a circular doughnut-like shape.

12. A color cathode ray tube apparatus according to claim 10, wherein said eight-pole permanent magnet means is substantially composed of a plurality of circular doughnut-like plates.

13. A color cathode ray tube apparatus according to claim 10, wherein said eight-pole permanent magnet means is formed in a circular doughnut-like shape which is splittable into a plurality of component members.

14. A color cathode ray tube apparatus according to claim 10, wherein intervals between two pairs of magnetic poles which are disposed at specific positions close to both sides of axis X of said eight-pole permanent magnet means and intervals between the other two pairs of magnetic poles disposed at specific positions close to both sides of axis Y of said eight-pole permanent magnet means are respectively narrower than those intervals between four pairs of magnetic poles which are apart from said axes X and Y.

15. A color cathode ray tube apparatus according to claim 10, wherein said two pairs of magnetic poles close to both sides of said axis Y which are narrower than an interval between a pair of side electron beams emitted from said electron gun assembly.

16. A color cathode ray tube apparatus according to claim 10, wherein, viewing said eight-pole permanent magnet means from said phosphorous screen, an N-magnetic pole is closest to said axis X in a clockwise direction.

17. A color cathode ray tube apparatus according to claim 10, wherein said eight-pole permanent magnet means generates pin-cushion type magnetic field which is capable of minimizing deflective aberration of electron means caused by another magnetic field generated by said second deflection coil of said deflective device.

18. A color cathode ray tube apparatus as in claim 10, wherein said two pairs of magnets close to the X-axis are shorter than a distance between the side beams.

19. A color cathode ray tube apparatus comprising:

a vacuum envelope comprising a panel section, a funnel section, and a neck section; wherein said panel section comprises an axis, a face plate, an inner surface, a skirt region extending from a peripheral edge of said face plate, and a front viewer which is substantially of rectangular shape; wherein said funnel section is continuously connected to said neck section, and wherein said neck section is substantially of a cylindrical shape;

a phosphorous screen which is provided on the inner surface of said face plate;

a shadow mask which is disposed in said panel section and opposes said phosphorous screen provided on said face plate;

an in-line type electron gun assembly which is stored in said neck section, wherein said electron gun assembly comprises an electron beam generator which generates and controls three electron beams consisting of a central electron beam and two pairs of side electron beams and a main electron lens section which accelerates, focuses, and converges said three electron beams, and a deflection device comprising a first deflection coil which deflects said three electron beams emitted from said electron gum assembly in the in-line direction substantially in a horizontal axis direction and a second deflection coil which deflects said three electron beams in a vertical axis direction, and a core which accommodates said second deflection coil wound thereon;

a eight-pole permanent magnet means, provided in the periphery of a tubular axis between an end region of said deflection device and said main electron lens section of said electron-gun assembly, and wherein said eight-pole permanent magnet means generates a specific magnetic field capable of minimizing deflective aberration of said three electron beams caused by a deflected magnetic field of said deflection device, wherein a specific magnetic flux density of two pairs of magnetic poles of said eight pole permanent magnet means, which two pairs are disposed at specific positions close to both sides of a Y axis direction of said eight-pole permanent magnet means is larger than a specific magnetic flux density of an other two pairs of magnetic poles, which other two poles are disposed at specific positions close to both sides of an X axis of said eight-pole permanent magnet means.

20. A color cathode ray tube apparatus as in claim 19, wherein said two pairs of magnets close to the X-axis are shorter than a distance between the side beams.

21. A deflection device for a color cathode ray tube apparatus comprising a panel section, a funnel section, and a neck section internally securing an electron-gun assembly, wherein said deflection device comprises:

a first deflection coil which deflects three electron beams emitted from said electron-gun assembly in the in-line direction substantially in a horizontal axis direction;

a second deflection coil which deflects said three electron beams emitted from said electron-gun assembly in a vertical axis direction;

a core which accommodates said second deflection coil wound thereon;

an eight-pole permanent magnet means which is provided in the periphery of tubular axis between an end region of said deflection device and said main electron lens section of said electron-gun assembly, and wherein said eight-pole permanent magnet means generates a specific magnetic field capable of minimizing deflective aberration of said three electron beams caused by deflected magnetic field of said deflection device, wherein a specific magnetic flux density of two pairs of magnetic poles of said eight pole permanent magnet means, which two pairs are disposed at specific positions close to both sides of a Y axis direction of said eight-pole permanent magnet means is larger than a specific magnetic flux density of an other two pairs of magnetic poles, which other two poles are disposed at specific positions close to both sides of an X axis of said eight-pole permanent magnet means.

22. A color cathode ray tube apparatus as in claim 20, wherein said two pairs of magnets close to the X-axis are shorter than a distance between the side beams.

* * * * *